US008333100B2

(12) United States Patent
Takeshita et al.

(10) Patent No.: US 8,333,100 B2
(45) Date of Patent: Dec. 18, 2012

(54) MULTI-PROCESS PRESS MACHINE AND PRESS-WORKING METHOD

(75) Inventors: Kengo Takeshita, Kariya (JP); Takeshi Kurosawa, Chita-gun (JP); Nobuyuki Morikawa, Toyoake (JP)

(73) Assignee: Denso Corporation, Kariya (JP)

( * ) Notice: Subject to any disclaimer, the term of this patent is extended or adjusted under 35 U.S.C. 154(b) by 250 days.

(21) Appl. No.: 12/905,527

(22) Filed: Oct. 15, 2010

(65) Prior Publication Data

US 2011/0100172 A1 May 5, 2011

(30) Foreign Application Priority Data

Oct. 29, 2009 (JP) ..... 2009-249329

(51) Int. Cl.
*B21J 11/00* (2006.01)

(52) U.S. Cl. ..... 72/404; 72/405.01; 72/405.06

(58) Field of Classification Search ..... 72/311, 72/342.7, 350, 351, 361, 404, 405.01, 405.06, 72/417, 419, 452.4, 452.5, 455, 482.9
See application file for complete search history.

(56) References Cited

U.S. PATENT DOCUMENTS 5,720,198 A 2/1998 Nishida et al.
5,761,994 A 6/1998 Itakura
6,053,027 A 4/2000 Yoshizawa

FOREIGN PATENT DOCUMENTS

| | | |
|---|---|---|
| JP | A-6-297195 | 10/1994 |
| JP | A-8-52597 | 2/1996 |
| JP | A-8-206883 | 8/1996 |
| JP | A-10-156449 | 6/1998 |
| JP | A-2001-58296 | 3/2001 |
| JP | A-2007-229738 | 9/2007 |

*Primary Examiner* — Dana Ross
*Assistant Examiner* — Homer Boyer
(74) *Attorney, Agent, or Firm* — Oliff & Berridge, PLC

(57) ABSTRACT

A press machine able to press-work a strip-shaped material during which it can prevent the strip-shaped material from moving or warping or can prevent the strip-shaped material from partially cracking and a processing method using that press machine. A multi-process press machine provided with a drive source M, a camshaft 1 driven by the drive source M and having a plurality of independent first cams 1*a*, 1*b*, and 1*c* and second cams 1*h*, 1*i*, and 1*j*, a plurality of die sets each comprised of a pair of a punch 2 and a die 3 connected with the first cam, a material holding member 7 pressing the strip-shaped material W against the die 3 when connecting with and pressing the second cam, and a base 5 supporting the dies.

5 Claims, 5 Drawing Sheets

MULTI-PROCESS PRESS MACHINE AND PRESS-WORKING METHOD

TECHNICAL FIELD

The present invention relates to a multi-process press machine and press-working method for press-working a strip-shaped material by a plurality of processes.

BACKGROUND ART

In recent years, press-working has become more automated and higher in efficiency. Multi-process press machines which using single systems to simultaneously perform a plurality of shaping operations are becoming more popular. This type of press has a plurality of bottom dies arranged on a bed. A crankshaft is rotated to raise and lower slides from which top dies are suspended in the shaping order. A workpiece is conveyed by a conveyor system. In combination, automated press-forming work is performed. That is, a workpiece is clamped and pressed between the dies of a first process. When one shaping operation is completed, the conveyor system is operated to move the workpiece horizontally to the next adjoining dies where the next shaping operation is performed. By repeating this procedure, a single press machine can be used to perform a shaping operation with a large working rate through a plurality of processes in an integrated manner, so processing with a high work efficiency and good productivity is realized.

However, in a conventional multi-process press machine, linked with rotation of a single crankshaft, connecting rods engaged with eccentric parts are simultaneously raised and lowered and slides hanging from their bottoms are raised and lowered to press several aligned workpieces all at once. For this reason, at this time, the load applied to the press machine becomes the total of all of the working loads in the plurality of dies. If assuming a single press machine provided with three types of dies and performing three processes of press-forming simultaneously, if the load occurring at the first process is K1, the load occurring at the second process is K2, and the load occurring at the third step is K3, since these press-forming operations proceed simultaneously, the total of the loads occurring at the press machine as a whole becomes the total of the individual loads or K1+K2+K3=KT. Naturally, if the number of processes of working increases and further the larger the shaping ratio per process, the larger the total value becomes. To withstand the resultant massive load, the press machine must be made extremely strong in rigidity. In the end, the press machine becomes massive, the required installation area becomes greater, and the ancillary facilities also become large in size. Further, in recent press machines, the shaped products are becoming increasingly diverse in type. Even the products shaped by a single machine come in thousands and tens of thousands of types. For this reason, in a massive press machine, frequently the generally excessive capacity detracts from the universal applicability. In particular, if producing a small number of pressed products which can be formed by a light load by a massive facility, the loss becomes too great and the prime units of energy rise resulting in lower productivity. On top of the prime units of production, there is a high risk of a large detrimental effect being felt. In such a case, it becomes necessary to provide separate light load press machines in parallel.

Press machines solving such problems, that is, press machines relatively small in size and sufficiently economic in structure despite performing multiple processes, are disclosed in PLTs 1 and 2. For example, the art disclosed in the PLT 2 is as follows: That is, this provides a multi-process press machine providing a single press machine with three dies and performing three processes. In this press machine, the eccentric parts of the crankshaft do not have a single eccentric axis, but are provided with three eccentric axes shifted in phase. For this reason, at the instant at which the first process is being performed, the second and third processes are not being executed. The load applied to the press machine as a whole at this time becomes just the load K1 of the first process. After the first process ends and the crankshaft rotates by exactly a predetermined angle, the second process is executed. The load applied to the press machine as a whole at this instant is just the load K2 of the second process. When the second process ends and the crankshaft rotates by exactly a further predetermined angle, the third process starts and the load K3 is generated. In this way, the press-working operations are performed consecutively offset in time, so for the maximum load applied to the press machine as a whole, it is sufficient to assume the largest of the individual loads, that is, K3.

However, in the above-mentioned multi-process press machine, while press-working a workpiece, sometimes the workpiece will move or warp or the workpiece will partially crack resulting in a large drop in the quality of the final processed product. Such trouble is believed to occur, first, because the workpiece is a strip-shaped material and the workpiece has to be conveyed between a plurality of processes, so such a phenomenon occurs at the time of plastic-working.

CITATION LIST

Patent Literature

PLT 1: Japanese Patent Publication (A) No. 206883
PLT 2: Japanese Patent Publication (A) No. 6-297195
PLT 3: Japanese Patent Publication (A) No. 2007-229738

SUMMARY OF INVENTION

Technical Problem

The present invention was made in consideration of the above problems and has as its object the provision of a multi-process press machine and press-working method press-working a strip-shaped material by a plurality of processes which can prevent the strip-shaped material from moving or warping or can prevent the strip-shaped material from partially cracking while press-working the strip-shaped material.

According to a first aspect of the present invention, the multi-process press machine (100) is a multi-process press machine (100) press-working a strip-shaped material (W) by a plurality of processes, the multi-process press machine (100) provided with a drive source (M), a camshaft (1) driven by the drive source (M) and having a plurality of independent first cams (1*a*, 1*b*, 1*c*, 1*d*, 1*e*, and 1*f*) and second cams (1*h*, 1*i*, 1*j*, 1*k*, 1*l*, and 1*m*), a plurality of die sets, each die set comprised of a punch (2) and die (3) connected with a first cam, material holding members (7) connected with the second cams and holding the strip-shaped material (W) against the dies (3) at the time of press-working, and a base (5) supporting the die sets, the plurality of die sets being arranged along an axial direction of the camshaft (1), each first cam being formed with a profile suitable for each process so that each first cam works with each punch (2) and die (3) to perform the press-working at each process, and the strip-shaped material (W) being made to move along the axial direction of the camshaft (1) between each punch (2) and each die (3) each predetermined pitch so that the cooperative press work of each punch (2) and die (3) at each process is successively executed at time intervals from each other.

In a press machine which can perform several types of working processes by a single press machine, the material holding members connected to the second cams can hold the strip-shaped material (W) against the dies (3) while press-working the strip-shaped material. For this reason, while press-working the strip-shaped material, it becomes possible to prevent the strip-shaped material from moving or warping or the strip-shaped material from partially cracking. Further, when not press-working it, the held state can be released and the strip-shaped material (W) can be conveyed.

According to a second aspect of the present invention, the material holding members (7) have parts (7*d*) holding the strip-shaped material (W). Due to this structure, it becomes possible to simplify the multi-process press machine and becomes possible to improve the process speed as well.

According to a third aspect of the present invention, the multi-process press (100) works the strip-shaped material (W) to a part for a heat exchanger. This clearly shows a specific form of a processed part.

According to a fourth aspect of the present invention, a plurality of press-working units executing one process of the press-working are connected to each other and execute the press-working of a plurality of processes.

By structuring the multi-process press machine (100) from a plurality of press-working units connected together, when changing the processes, it is possible to not only change the camshaft, but also add, delete, or change the press-working units and thereby change the process of the press-working. That is, it becomes possible to quickly and flexibly deal with changes in processes of press-working by a low cost.

The method of working a strip-shaped material (W) using a multi-process press machine (100) is characterized in that each of the plurality of processes of press-working comprises a step of holding the strip-shaped material (W) against a die (3), a step of making the punch proceed toward the strip-shaped material (W), strike the strip-shaped material (W), and press-work the strip-shaped material (W), and a step of making the strip-shaped material (W) move along the axial direction of the camshaft (1) between each punch (2) and each die (3) by a predetermined pitch.

In a press-working method which can perform several types of working processes by a single press machine, it becomes possible to use material holding members to hold the strip-shaped material (W) against the dies (3) while press-working the strip-shaped material. For this reason, while press-working the strip-shaped material, it becomes possible to prevent the strip-shaped material from moving or warping or the strip-shaped material from partially cracking.

Below, embodiments of the present invention will be explained with reference to the drawings. Note that, in FIG. 1 to FIG. 5, members or means having the same function will be assigned the same symbols or numbers and explanations will be omitted.

DESCRIPTION OF EMBODIMENTS

Figure 1:
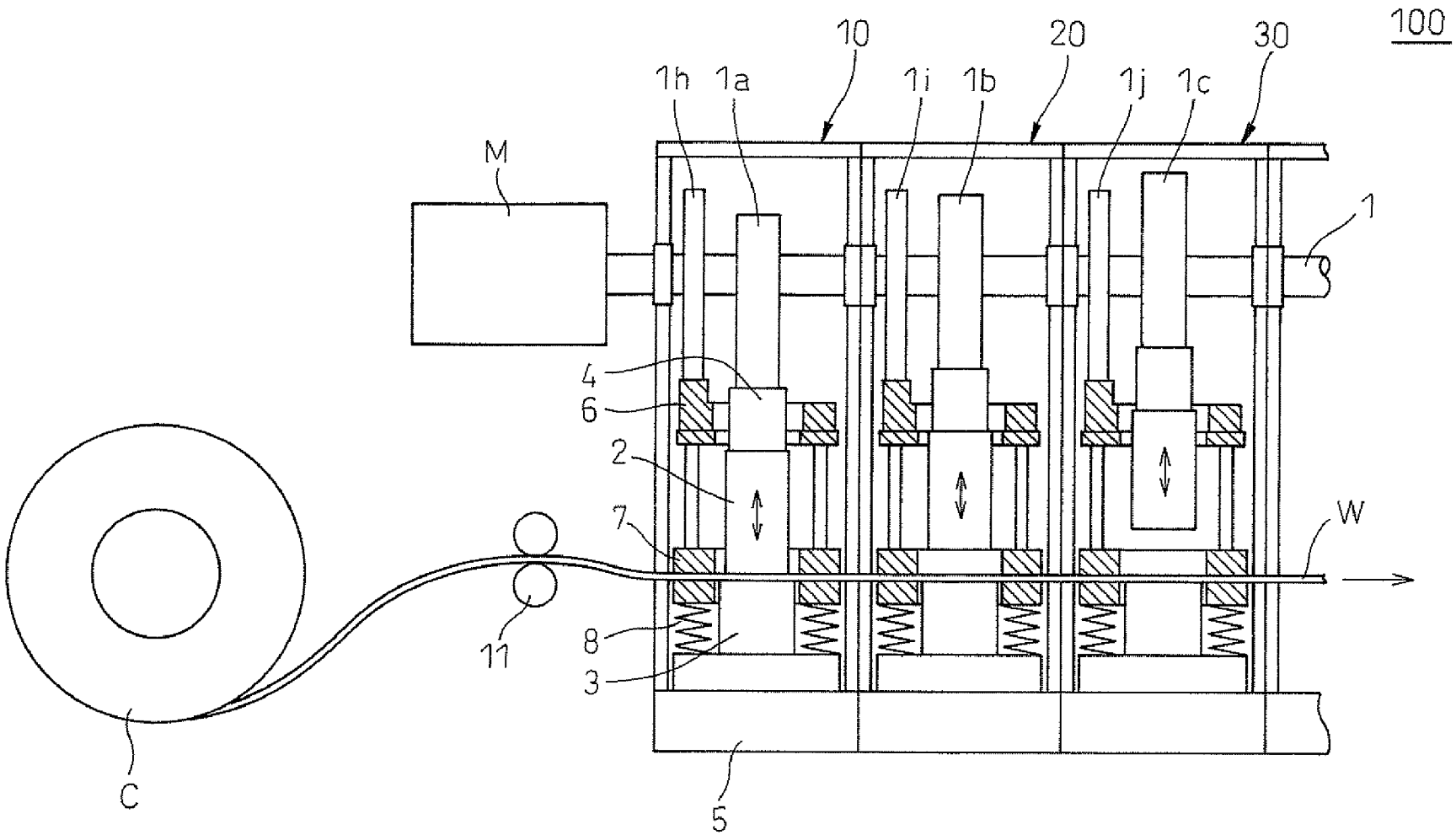
FIG. 1 is a schematic cross-sectional view of a press machine of the present invention.

A multi-process press machine 100 according to the present invention is schematically shown in FIG. 1. The press 100 machine is provided with a servo motor M, a camshaft 1 connected to the servo motor M and driven by the servo motor M, and six consecutive press-working units 10, 20, 30, 40, 50, and 60. Note that the press-working units 40, 50, and 60 are omitted from the illustration due to the space limitations.

The multi-process press machine 100 is comprised of a plurality of press-working units executing single processes of press-working connected with each other and thereby performs press-working of a plurality of processes. By structuring the multi-process press machine 100 by a plurality of press-working units connected together, when changing the processes, it is possible to not only change the camshaft, but also add, delete, or change press-working units and thereby change the process of the press-working. That is, it becomes possible to quickly and flexibly deal with changes in processes of press-working by a low cost.

The camshaft 1 is provided with six first cams (for press-working workpiece) 1*a*, 1*b*, 1*c*, 1*d*, 1*e*, and If and six second cams (for holding workpiece) 1*h*, 1*i*, 1*j*, 1*k*, 1*l*, and 1*m*. The first cams and the second cams are alternately arranged. One first cam and one second cam adjoining that first cam form a set of cams. That is, the first cam 1*a* and second cam 1*h*, the first cam 1*b* and second cam 1*i*, and the first cam 1*c* and second cam 1*j* form sets of cams. In the same way, the first cams and the second cams form sets of cams.

Figure 2:
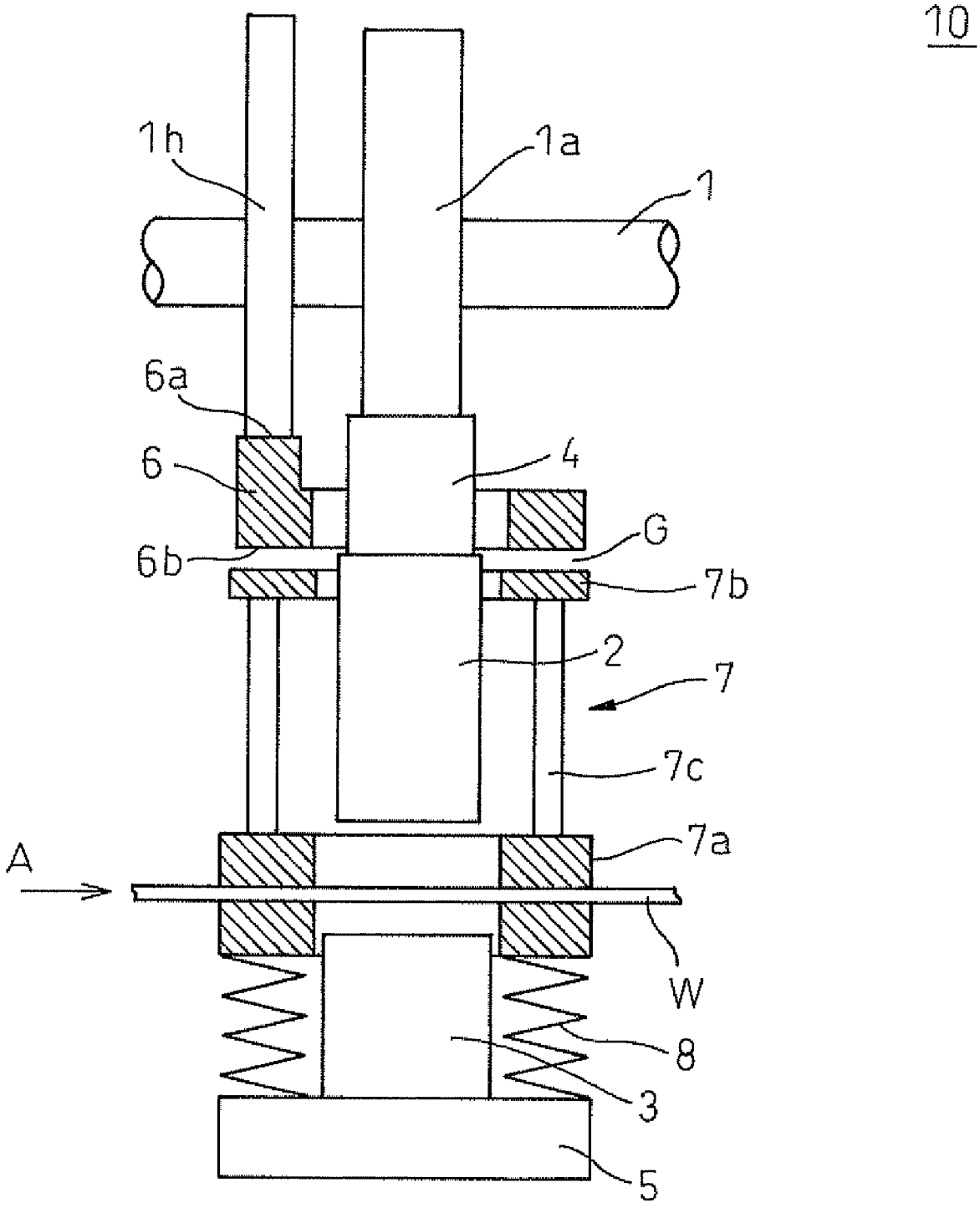
FIG. 2 is a detailed explanatory view of a press-working unit of FIG. 1.

A detailed explanatory view of the press-working unit 10 is shown in FIG. 2. As shown in FIG. 2, the press-working unit 10 is provided with a press follower 4 connected to a first cam 1*a*, a punch (top die) 2 receiving a holding force by the press follower 4, a die (bottom die) 3 paired with the punch, and a base 5 supporting the die 3. The press follower 4 is arranged to be able to slide in a cylinder (not shown). It is biased by a return spring (not shown) to the first cam side (top direction) and constantly abuts against the first cam profile surface.

The working unit 10 is further provided with a workpiece holding follower 6 connected with the second cam 1*h*. The holding follower 6 is biased by return springs (not shown) to the second cam side (top direction). The top surface 6*a* is constantly abutting against the second cam profile surface. The holding follower 6 is a roughly rectangular shape with an opening at its center when seen from the top. The part for abutting with the second cam 1*h* sticks out from the main body. Inside the hole at the center, a press follower 4 and punch 2 are arranged. Further, directly below the holding follower 6, a workpiece holding member 7 is arranged. When the workpiece W is press-worked, the bottom surface 6*b* of the holding follower 6 abuts against the top surface of the workpiece holding member 7, transmits the cam lift displacement (cam force) to the workpiece holding member 7, and holds the workpiece W against the die 3. Note that, other than when performing a process where the workpiece W is press-worked, there is a gap G between the holding follower 6 and the workpiece holding member 7.

Figure 3:
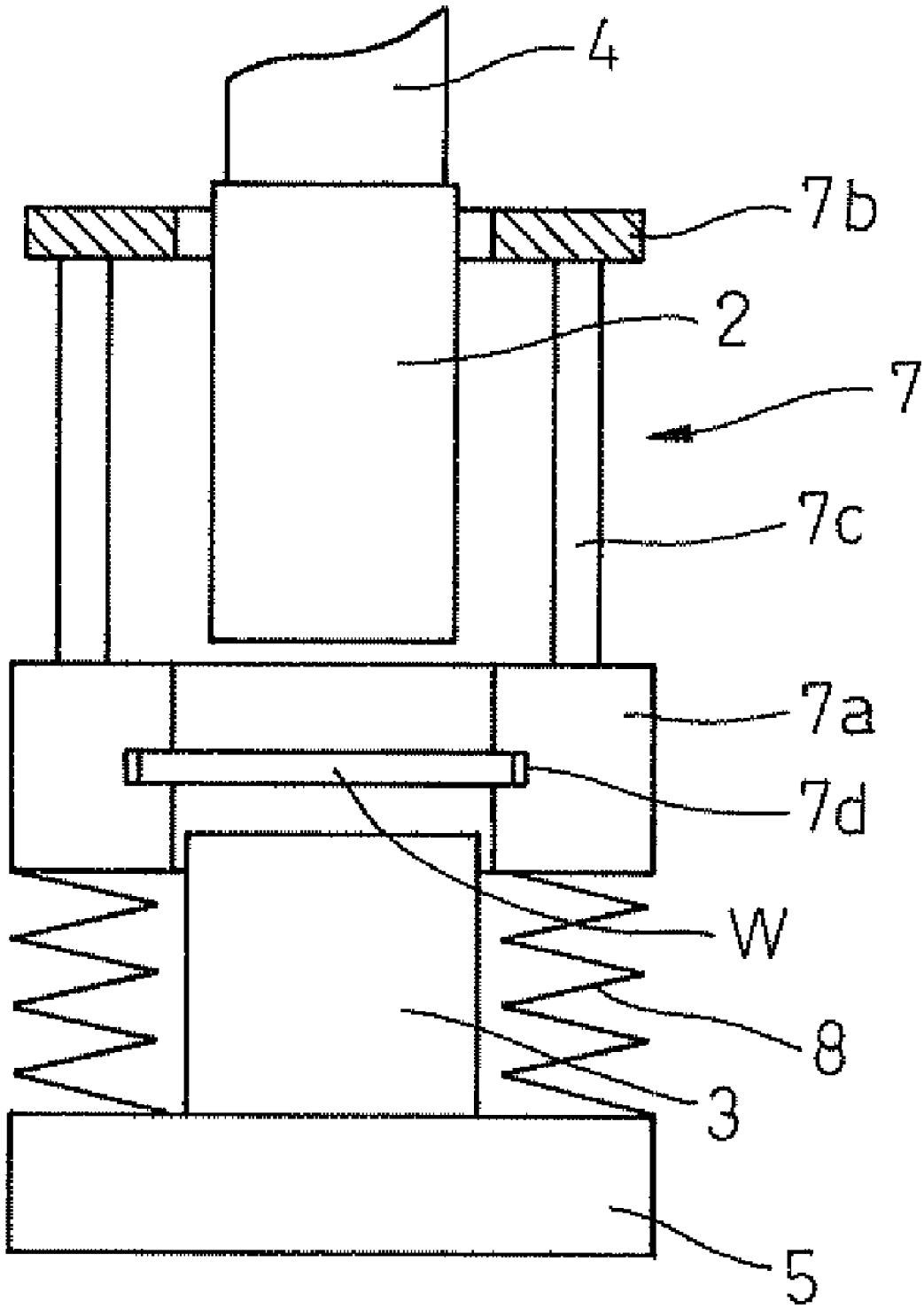
FIG. 3 is a view of the press-working unit of FIG. 2 seen from a direction A.

A view of the press-working unit of FIG. 2 seen from the direction of progression A of the workpiece W is shown in FIG. 3. As shown in FIG. 3, the workpiece holding member 7 is provided with a workpiece holding member 7*a* for holding the workpiece W in the left-right direction, a cam force transmission member 7*b* which the holding follower 6 abuts against and transmits the lift displacement (cam force) of the cam 1*h*, and four cam force transmission columns 7*c* provided between the workpiece holding member 7*a* and the cam force transmission member 7*b*. Further, the workpiece holding member 7 is arranged above the base 5 through the workpiece holding member supporting springs 8. The workpiece holding member 7*a* is formed with U-shaped recesses 7*d* at the left and right. Due to the two U-shaped recesses 7*d*, the movement of the workpiece W is restricted. This holds the workpiece W.

The other working units 20, 30, 40, 50, and 60 are structured the same as the working unit 10. Further, a plurality of die sets (punches and dies) are arranged along the axial direction of the camshaft.

Returning to FIG. 1, a single camshaft 1 is provided passing through the six press-working units 10, 20, 30, 40, 50, and 60. The cams differ in shape (cam profile) from each other. The phase angles giving the maximum lift for executing the press-working operation are also shifted from each other.

The camshaft 1 rotates at for example 60 rpm. When the camshaft 1 starts rotating, first, the process in the press-working unit 10 is started. When the camshaft 1 rotates, the first cam 1*a* and second cam 1*h* arranged at the camshaft 1 also rotate. When the second cam 1*h* rotates, the holding follower 6 arranged in the press-working unit 10 displaces downward against a return spring (not shown). Further, the bottom surface 6*b* of the holding follower 6 abuts against the top surface of the workpiece holding member 7, transmits the cam lift displacement (cam force) to the workpiece holding member 7, and holds the workpiece W against the die 3.

Synchronously with the holding operation of the workpiece W by the rotation of the second cam 1*h*, a press-working operation is performed by the first cam 1*a*. That is, when the first cam 1*a* rotates, the press follower 4 arranged in the press-working unit 10 is displaced downward. This being the case, the punch 2 connected to the press follower 4 also displaces downward. As a result, the punch 2 proceeds toward the workpiece W, strikes the workpiece W, reaches the bottom dead center, and holds the workpiece W between the punch 2 and die 3 for press-forming.

Note that, right before the punch 2 reaches bottom dead center, that is, right before the workpiece W receives the press-working, as explained below, the workpiece W is already held against the die 3 by the workpiece holding member 7. While the workpiece W is being press-worked, the workpiece W is continuously held by the workpiece holding member 7. Further, after the press-working ends, the position at which the second cam 1*h* strikes the holding follower 6 rises. The workpiece holding member 7 is pushed back upward by the workpiece holding member supporting springs 8 while the workpiece W separates from the die 3 and the held state of the workpiece W is released.

In this way, while the workpiece W is being press-worked, the workpiece W is held by the workpiece holding member 7. For this reason, it becomes possible to prevent the workpiece W from moving or warping or the strip-shaped material from partially cracking while press-working the workpiece W. If the workpiece W moves or warps while press-working the workpiece W, the working precision remarkably drops and the rate of occurrence of defects rises.

Furthermore, when the camshaft 1 is rotating, the process in the press-working unit 20 is started. If the camshaft 1 is rotating, the first cam 1*b* and second cam 1*i* arranged at the camshaft 1 rotate. This being the case, a process the same as the process executed at the press-working unit 10 is executed. That is, the workpiece W is held by the holding follower 6 and workpiece holding member 7 connected to the second cam 1*i*. In the held state, the workpiece W is shaped by the press follower 4 and punch 2 connected to the first cam 1*b* when the press follower 4 arranged in the press-working unit 20 shaping the workpiece W reaches bottom dead center.

The processes in the press-working units 30 to 60 are consecutively executed together with rotation of the camshaft 1 in the same way. The principle of the process is the same, so the explanation will be omitted.

In this way, along with rotation of the camshaft 1, the press followers 4 consecutively reach bottom dead center and consecutively perform the shaping operations. The press-working operations do not overlap in time and are performed individually after certain time intervals. If assuming that the load (press load 9) generated at all processes is the same, the load occurring at the forging press as a whole simply speaking can be kept to ⅙ of the prior art.

The first cams differ in shape (cam profile) from each other. The phase angles giving the maximum lift for executing the press-working are also shifted from each other. The first cams 1*a*, 1*b*, 1*c*, 1*d*, 1*e*, and if are made to work with the punches 2 and dies 3 for the press-working at the different processes by forming the cams with profiles suitable for the different processes.

The press-worked workpiece W is a strip-shaped material with a width of for example 60 mm. The original material is in a coil C shape. The workpiece W is conveyed from the coil C through a conveyor roller 1*l* and passed intermittently between the punches 2 and dies 3 of the working units 10, 20, 30, 40, 50, and 60 while press-working it. When being press-worked, the workpiece W is stopped. The workpiece W is intermittently conveyed along the axial direction of the camshaft 1 by a predetermined pitch (for example, 30 mm) in the upward direction away from the die 3 finishing the press-working each time the press-working operation at each process is ended.

Figure 4:
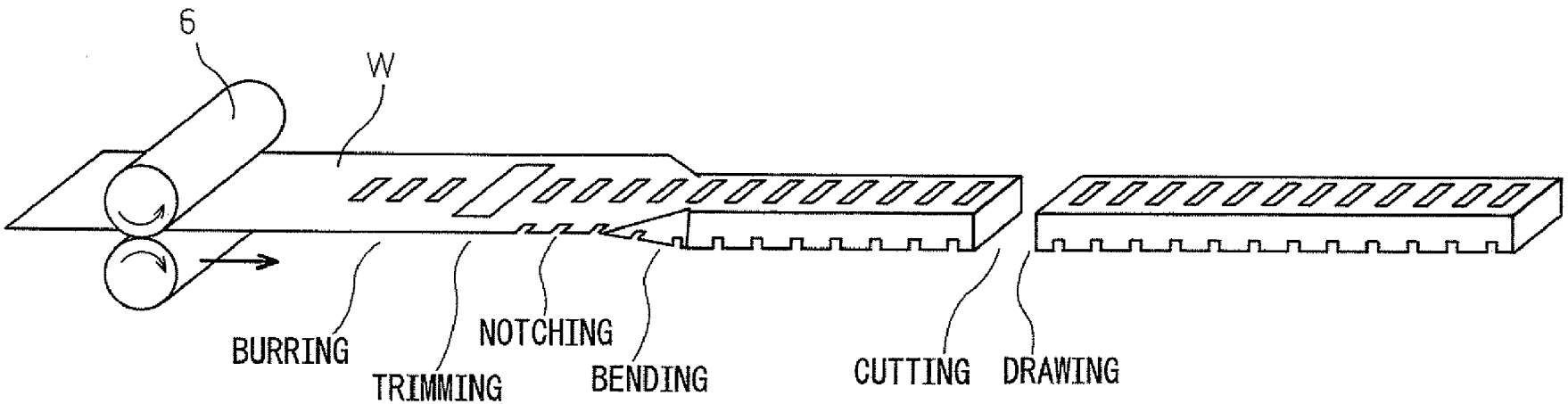
FIG. 4 is a schematic view of continuous press-working of a strip-shaped material.

FIG. 4 is a schematic view of consecutive press-working of a strip-shaped material W. The strip-shaped material W is a 1.2 mm thick aluminum material. Referring to FIG. 4, the six processes will be simply explained. The first process trims the strip-shaped material W, forms corners, draws the material straight, and forms the ribs. The second process straightens the corners, trims the material, and deburrs the corners. The third process straightens the straight parts, performs notching, burring, and pilot burring, and crushes the pilot parts. The fourth process trims the sides and deburrs the side parts. The fifth process bends the side parts. The sixth process draws the corners, bends the insert parts, and cuts the material.

Figure 5:
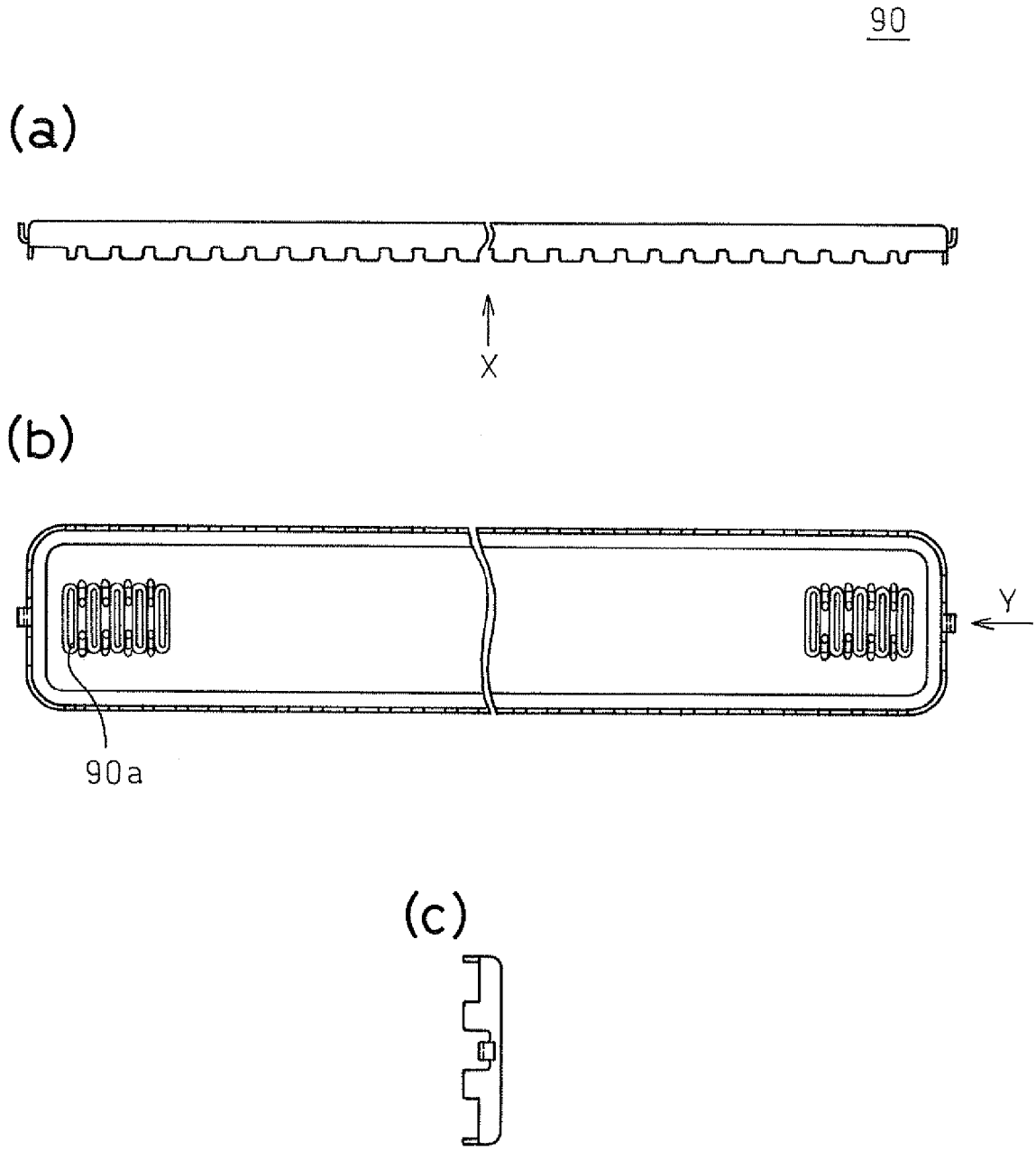
FIG. 5 is a view of a press-worked part of a heat exchanger.

A part for a heat exchanger is formed by these six processes. The processed heat exchanger part 90 is shown in FIG. 5. In FIG. 5, (a) is a side view of a part for a heat exchanger, (b) is a bottom view of (a) seen from the X-direction, and (c) is an end view of (b) seen from the Y-direction. Note that, 90*a* is a through hole through which is inserted a tube in which cooling water flows.

In the above way, by the multi-process press machine and press-working method press-working the strip-shaped material by a plurality of processes, it is possible to provide a press machine which can prevent the strip-shaped material from moving or warping or the strip-shaped material from partially cracking while pressing the strip-shaped material and a method of processing using the press machine.

The invention claimed is:

1. A multi-process press machine press-working a strip-shaped material by a plurality of processes, the multi-process press machine provided with a drive source, a camshaft driven by the drive source and having a plurality of independent first cams and second cams, a plurality of die sets, each die set comprised of a punch and die connected with a first cam, material holding members connected with the second cams and holding the strip-shaped material against said dies at the time of press-working, and a base supporting said die sets, said plurality of die sets being arranged along an axial direction of said camshaft, each first cam being formed with a profile suitable for each process so that each first cam works with each punch and die to perform the press-working at each process, and the strip-shaped material being made to move along the axial direction of said camshaft between each punch and each die each predetermined pitch so that the cooperative press work of each punch and die at each process is successively executed at time intervals from each other.

2. A multi-process press as set forth in claim 1, wherein said material holding members have parts holding said strip-shaped material.

3. A multi-process press as set forth in claim 1, which works said strip-shaped material to a part for a heat exchanger.

4. A multi-process press as set forth in claim 1, wherein a plurality of press-working units executing one process of the press-working are connected to each other and execute the press-working of a plurality of processes.

5. A method of working a strip-shaped material using a multi-process press machine as set forth in claim 1, wherein each of the plurality of processes of press-working comprises a step of holding the strip-shaped material against a die, a step of making said punch proceed toward said strip-shaped material, strike said strip-shaped material, and press-work said strip-shaped material, and a step of making the strip-shaped material move along the axial direction of said camshaft between each punch and each die by a predetermined pitch.

* * * * *